US007642023B2

(12) United States Patent
Nagase et al.

(10) Patent No.: US 7,642,023 B2
(45) Date of Patent: Jan. 5, 2010

(54) COLOR IMAGE FORMING METHOD

(75) Inventors: Tatsuya Nagase, Tachikawa (JP); Makoto Nomiya, Tokyo (JP); Kazuya Isobe, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 462 days.

(21) Appl. No.: 11/474,894

(22) Filed: Jun. 26, 2006

(65) Prior Publication Data

US 2007/0046963 A1 Mar. 1, 2007

(30) Foreign Application Priority Data

Aug. 24, 2005 (JP) ..... 2005-242405

(51) Int. Cl.
*G03G 15/01* (2006.01)

(52) U.S. Cl. ..... 430/45.4; 430/45.51; 430/123.53; 430/107.1

(58) Field of Classification Search ..... 430/45.4, 430/45.51, 123.53
See application file for complete search history.

(56) References Cited

U.S. PATENT DOCUMENTS 5,955,234 A * 9/1999 Matsunaga et al. ..... 430/109.3
5,968,701 A * 10/1999 Onuma et al. ..... 430/108.22
6,352,806 B1 * 3/2002 Dalal ..... 430/45.4
2002/0051924 A1 * 5/2002 Iida et al. ..... 430/109.3
2005/0095516 A1 * 5/2005 Ohmura et al. ..... 430/45

FOREIGN PATENT DOCUMENTS

| | | |
|---|---|---|
| EP | 0 836 121 A1 | 4/1998 |
| EP | 0 862 090 A1 | 9/1998 |
| JP | 10-20598 | 1/1998 |
| JP | 2004-118020 | 4/2004 |
| JP | 2004-142153 | 5/2004 |
| JP | 2005-157314 | 6/2005 |

OTHER PUBLICATIONS

Aoki, Takayoshi. Chemical Toner Technology and The Future. IS&T's NIP 19. Springfield, Virginia: The Society for Imaging Science and Technology. (2003) pp. 2-4.*
European Search Report for European Application No. 06253288.2-2209 dated Jan. 17, 2007.

* cited by examiner

*Primary Examiner*—Christopher RoDee
(74) *Attorney, Agent, or Firm*—Cantor Colburn LLP

(57) ABSTRACT

An object of the present invention is to provide a color image forming method capable of forming full color images desired for a precise reproduction to the color tone of high resolution and a halftone in high-end apparatuses. Disclosed is a color image forming method employing 6 kinds of chromatic color toners and a black toner, each toner containing particles having a median particle diameter ($D_{50}$) of 3-7 μm in terms of volume, a decline starting temperature of a storage elastic modulus of 10-40° C., a temperature of 70-130° C. in the storage elastic modulus range of $10^3$-$10^4$ Pa, and a primary diameter of 40-800 nm.

20 Claims, 3 Drawing Sheets

COLOR IMAGE FORMING METHOD

TECHNICAL FIELD

The present invention relates to a color Image forming method via an electrophotographic process employed in copy machines and printers.

BACKGROUND

Demands for full-color prints include some occasions where a volume of orders placed is as small as about several tens of sets to hundreds of sets and beautiful color reproduction is requested. For example, in the order placement for leaflets or posters each containing a company logo, high quality is requested including a requirement for high fidelity color reproduction for a logo that reflects a company color, contrary to a small amount of orders placed, which has been a nuisance for a printing shop where a large number of prints are brought out by making a plate.

In the meantime, even in the field of an image forming technology by electrophotographic process, there has come an opportunity to enter into the print industry where there is a demand for the high speed creation of prints having high resolution and broad color reproduction area by a full-color image forming apparatus employing color toner, owing to the progress of digitalization of recent date.

As one of full-color image forming methods, there is an image forming method called a tandem system. This method is one wherein toner images of respective colors are formed respectively on a plurality of photoreceptors, and these color images are superimposed on an intermediate image transfer body or on a recording sheet, to form a full-color image (for example, see Patent Document 1). The tandem system is better suited for high speed printing because monochrome images and color images can be printed at the same speed in the tandem system. Specifically, based on image information corresponding to four colors of yellow, magenta, cyan and black, electrostatic latent images are formed on respective photoreceptors, and these electrostatic latent images are made to be toner images of respective colors by yellow toner, magenta toner, cyan toner and black toner. Then, these toner images are superimposed on an intermediate image transfer body or on a recording sheet to form a color image.

On the other hand, there is a machine model called a high-end machine that is requested to reproduce subtle hue on a high fidelity basis, in digital full-color image forming apparatuses (for example, see Patent Document 2). The equipment of this kind needs color toner capable of reproducing microscopic dot images and subtle hue on a high fidelity basis. However, in the color reproduction by the toner of four colors of yellow, magenta, cyan and black, a color area capable of reproducing is limited, and there has been a problem in preparation of printed matters wherein expression of subtle hue like the aforesaid company logo mark is often required.

For this problem, there is a technology capable of reproducing subtle hue on a high fidelity basis by expanding a color area in the course of color reproduction, which is represented by the existing full-color image forming method wherein hypochromic color toners are used together to interpolate color reproduction by four colors (for example, see Patent Documents 3 and 4).

As stated above, the full-color image forming technology by electrophotographic process has come to a level to reproduce subtle hue on a high fidelity basis by expanding a color area. However, the aforesaid technology is in the occasion where PPC paper (Plain Paper Copy) developed for electrophotography is used, and there has been no suggestion that excellent color reproduction can also be achieved even when a sheet for offset printing is used. Namely, it is inefficient for a person in printing business to conduct printing by changing a sheet for each equipment, and therefore, forming of toner images capable of reproducing colors in a broad color area by using a sheet for offset printing has been demanded.

In the meantime, a sheet for offset printing has two types including a glossy coated paper and a non-coated paper, and there exist the following problems to be solved for forming toner images on these sheets for offset printing on the image forming apparatus of an electrophotographic process.

The first problem is that the glossy coated paper for offset printing cannot withstand heating and pressure fixing in the image forming process of an electrophotographic process. On the glossy coated paper for offset printing, there are coated resin emulsions such as wax having a melting point of 100-160° C. and polyacrylamide, thus, when intense heat is applied, a glossy layer is damaged, resulting in disturbed gloss. In addition, moisture remaining in cellulose pulp fibers representing a base changes into moisture vapor in the course of fixing to jet out, which causes a problem that image defect of white spots called toner blisters is generated. On the other hand, there is available a sheet for exclusive use which is coated so that moisture vapor can be transmitted, for electrophotography. However, this sheet for exclusive use has not been accepted easily by commercial printers, for the reasons that two-sided printing is extremely difficult in terms of specifications, and texture is different from a sheet for offset printing.

The second problem is that an amount of moisture in the non-coated paper for offset printing tends to fluctuate. In offset printing, hydrophilic property of the paper surface is enhanced, because immersion water is used for printing. Further, paper strength agents are added so that fillings may not be exfoliated from fibers on the paper surface, even when the sheet gets wet with water. As paper strength agents, polyvinyl alcohol has come to be used recently for enhancing papermaking speed, although cationic starch has been used in the past. Since an amount of moisture tends to fluctuate under the influence of paper strength agents, and paper resistance is low in the case of the non-coated paper as stated above, if the non-coated paper is used for image forming of electrophotographic process, transferability tends to be fluctuated. Further, since paper strength agents are not designed under the assumption of heating, it is necessary to consider not to cause thermal denaturation.

[Patent Document 1] Japanese Patent O.P.I. Publication No. 10-20598

[Patent Document 2] Japanese Patent O.P.I. Publication No. 2005-157314

[Patent Document 3] Japanese Patent O.P.I. Publication No. 2004-118020

[Patent Document 4] Japanese Patent O.P.I. Publication No. 2004-142153

SUMMARY

As stated above, a technology to form an excellent toner image on a sheet other than PPC paper such as a sheet for offset printing is not established sufficiently, and there has been desired a full-color image forming apparatus capable of making printed matters without preparing a plate independently of sheet types. An object of the invention is to provide a full-color image forming method wherein color images having subtle hue can be reproduced stably on a high fidelity basis without being affected by natures of a sheet when forming images by using a sheet other than PPC paper such as a sheet for offset printing. Disclosed is a color image forming method possessing the steps of charging plural photoreceptors; conducting an exposure process to each of surfaces of the plural photoreceptors charged in the forgoing charging process to form plural electrostatic latent images; developing the plural electrostatic latent images with plural different color toners corresponding to the plural electrostatic latent images to form plural different color toner images via the foregoing exposure process; and conducting a transferring process via superimposition of the plural different color toner images on a recording material or an intermediate image transfer material, wherein the plural different color toners comprise at least 6 kinds of chromatic color toners having different reflection spectra and a black toner, and the at least 6 kinds of chromatic color toners and the black toner each toner contains particles having a median particle diameter ($D_{50}$) of 3-7 μm in terms of volume, a decline starting temperature of a storage elastic modulus of 10-40° C., a temperature of 70-130° C. in the storage elastic modulus range of $10^3$-$10^4$ Pa, and a primary diameter of 40-800 nm.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
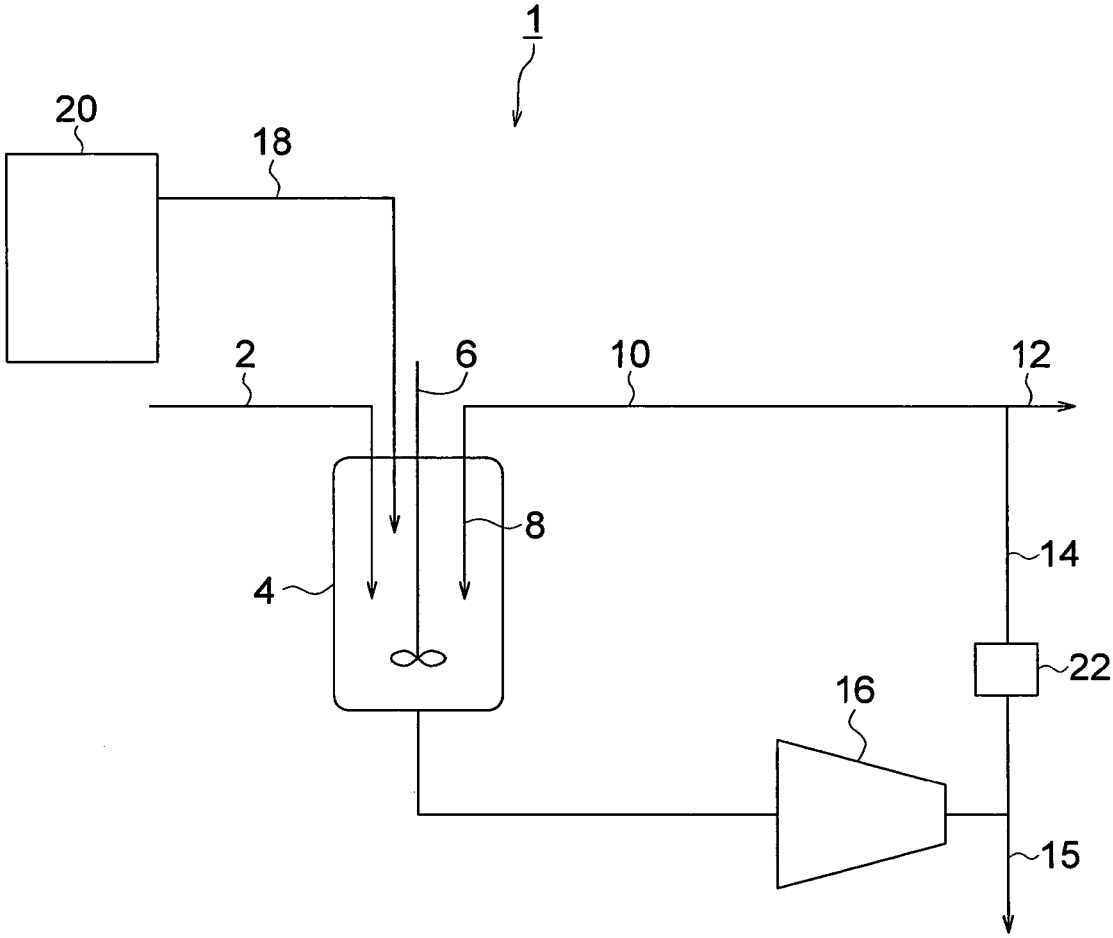
FIG. 1 is an illustration diagram showing an example of a reaction apparatus employed for polymerization of a vinyl polymer.

The present invention will be explained in detail as follows.

Toner used in the present invention will be explained, first.

In the present invention, toner images can be formed by using at least six types of chromatic colors each having a different reflectance spectrum and black toner. Since images are formed by using plural types of color toners each having a different reflectance spectrum as stated above, superposition of toner can be reduced more than the occasion where a color image is formed by combining color toners of three colors including yellow, magenta and cyan as in the past. As a result, when forming an image having desired hue, the image can be realized with an amount of toner that is less than that in the past, whereby, an image-formable color area can be expanded, and in particular, color reproduction for the color image having density like a halftone image can be carried out on a high fidelity basis.

Six kinds of chromatic color toners having different reflection spectra which are usable in the present invention will be further explained. Specific examples of six kinds of chromatic color having different reflection spectra which are usable in the present invention are provided below. (1) toner in which reflectance at not less than 500 nm and less than 730 nm is relatively higher than that at not less than 380 nm and less than 500 nm. (2) toner in which reflectance at not less than 380 nm and less than 500 nm is relatively higher than that at not less than 500 nm and less than 730 nm. (3) toner in which reflectance at not less than 500 nm and less than 600 nm is relatively higher than that at not less than 380 nm and less than 500 nm, and at not less than 600 nm and less than 730 nm. (4) toner in which reflectance at not less than 380 nm and less than 500 nm, and at not less than 600 nm and less than 730 nm is relatively higher than that at not less than 500 nm and less than 600 nm. (5) toner in which reflectance at not less than 600 nm and less than 730 nm is relatively higher than that at not less than 380 nm and less than 600 nm. (6) toner in which reflectance at not less than 380 nm and less than 600 nm is relatively higher than that at not less than 600 nm and less than 730 nm.

In the present invention, it is also possible to employ toner having a reflection spectrum other than those specified in (1)-(6).

The reflection spectrum of chromatic toner usable in the present invention is also measured as described below. As a sample for measurement, s monochrome solid image is formed so as to provide a toner coating amount of 5 g/$m^2$ on a transfer paper sheet with whiteness of 80-85% and a basis weight of 80 g/$m^2$ before fixing while heating. Next, under the fixing condition with a heat roller temperature of 180° C., a fixing speed of 220 mm/sec, a heat roller diameter of 65 mm (the heat roller covered by a PFA tube), a pressure roller diameter of 55 mm, and a surface pressure during fixing of 2.9 kgf/$cm^2$, the foregoing monochrome solid image is fixed while heating to measure the reflection spectrum employing a formed fixing image as a measured sample.

A reflection spectroscopy meter (referred to also as a spectrophotometer or a color analyzer) by which reflection wavelength characteristics in the visible region (380-780 nm) are measurable is employed as a reflection spectrum measuring apparatus. Specifically provided are measuring apparatuses such as GretagMcbethSpectroScan (produced by Gretag-Macbeth) and the like.

Meanwhile, specific examples of colorant to be used for toner related to the present invention will be described afterward.

Since color images are formed by less amount of toner by reducing superposition of toner, in the present invention, fixing can be carried out by heat that is less by an amount corresponding to the reduced amount of toner. As a result, it is possible to improve fixing strength of images, and in halftone images, in particular, its fixing strength can be more improved than in the past.

In the present invention, it is also possible to use white toner and transparent colorless toner together, in addition to the aforesaid seven types of toners each having a different color. Since it is possible to improve gradation characteristics for gray color and dark color by using white toner, it is possible to reproduce a certain gray color and dark color without depending on whiteness of a sheet. Since it is further possible to form a white image section by white toner without depending on whiteness of a sheet, it is possible to reproduce, in particular, a highlight portion to be beautiful.

When the transparent color toner is used, a gloss is given to a toner image to improve image quality. Further, a layer of the transparent colorless toner is formed on the image surface when the transparent colorless toner is used. Therefore, chromatic color toner layers are protected, and heat and pressure both applied in the course of fixing are relieved to restrain an amount of toner deformation, which makes it possible to form an image having high resolution.

When using the transparent colorless toner, it is preferable that a layer of the transparent colorless toner is arranged on each of the uppermost layer and the lowermost layer of the image, and when the layer of the transparent colorless toner is arranged on the uppermost layer, a gloss is given to the toner image and the colored toner layer is protected as described above. Further, when the transparent colorless toner is used for the lowermost layer, transfer-residual toner remaining on the photoreceptor becomes low-cost toner having less coloring material, resulting in a reduced print cost. To arrange the layer of the transparent colorless toner is positioned at the uppermost layer and/or the lowermost layer of the image, the toner image of transparent colorless toner should be transferred from the photoreceptor or the intermediate medium at the first or the end.

When the use of the transparent colorless toner is changed depending upon a type of the image, an image with the finish according to characteristic features of each image is formed, and an improvement to higher image quality is realized. For example, it is possible to provide a literal image which is easy to read, by using transparent colorless toner only on the lowermost layer for a portion of characters among the image, and to provide an excellent photographic image by using transparent color toner on both the lowermost layer and the uppermost layer for the photographic image portion.

Median particle diameter in terms of volume ($Dv_{50}$) of the toner of the present invention is 3-7 μm. It is possible that small dot images constituting photographic images and fine lines are precisely reproduced by having a toner particle diameter in the foregoing range.

The median particle diameter in terms of volume is measured and calculated by using Multisizer 3 (produced by Beckman Coulter Inc.), connected with a computer system (produced by Beckman Coulter Inc.) for data processing.

Measurement is carried out as follows: A surfactant solution is prepared, for example, by 10 times diluting a commercially available neutral detergent containing a surfactant with pure water. 20 ml of the surfactant solution is mixed with 0.02 g of toner. After making the toner blended with the surfactant solution, the mixture is subjected to an ultrasonic dispersion for one minute to obtain a toner dispersion. The toner dispersion is then poured, using a pipette, in a beaker containing ISOTON II (diluent; produced by Beckman Coulter Inc.) placed in a sample stand, until the content indicated in the monitor increased to 5-10% by weight. The count number of particles is set at 2500. In addition, a 30 μm aperture of Multisizer 3 is used.

With respect to toner used in the present invention, its decline-starting temperature of a storage elastic modulus is 10-40° C., and a temperature in the range of $10^3$-$10^4$·Pa in storage elastic modulus is 70-130° C., and preferably 80-120° C. In the present invention, attention was paid to dynamic viscoelasticity of toner as stated above, and by designing toner so that the storage elastic modulus in the specific range may be expressed in the specific temperature range, and excellent color reproducibility and stable fixing capability on a sheet other than PPC paper have been made to be expressed, by designing toner so that the storage elastic modulus in the specific range may be expressed in the specific temperature range. In particular, by using toner that satisfies the aforesaid conditions, it is possible to form a fixed image without worrying an influence of moisture evaporation, even when a toner image is formed on a sheet for offset printing that contains more moisture than that contained in PPC paper.

With regard to dynamic viscoelasticity, strain or stress that changes with time like sine vibration is given to a sample, and stress or strain corresponding to the foregoing is measured to evaluate viscoelasticity of the sample. Viscoelasticity obtained through the sine vibration as stated above is called the dynamic viscoelasticity, and on the dynamic viscoelasticity, elastic modulus obtained by the sine vibration is expressed in a form of a complex number.

Elastic modulus G is a ratio of stress σ applied to a sample to strain γ generated by action of strain γ, and elastic modulus in dynamic viscoelasticity is designated as complex elastic modulus G*. That is to say, complex elastic modulus G* in dynamic viscoelasticity, together with stress σ* and strain γ* is expressed by the following formula.

$$G^*=\sigma^*/\gamma^*.$$

A real part and an imaginary part of complex elastic modulus G* are designated as storage elastic modulus and loss elastic modulus, respectively. The storage elastic modulus as a factor of specifying toner usable in the present invention will be explained below.

When amplitude $\gamma_0$, angular frequency ω and sine strain γ are applied to a sample, the sine strain is expressed by the following formula.

$$\gamma=\gamma_0 \cos \omega t$$

In this case, stress having the same angular frequency is generated in the sample. Since the phase of stress σ is ahead of that of strain by an amount of δ, the following formula is expressed.

$$\sigma=\sigma_0 \cos (\omega t+\delta)$$

Here, Euler's formula eiωt=cos ωt+i sin ωt is utilized, and when these formulae are expressed in complex number, sine strain γ* and stress σ* generated by action of γ* are expressed by the following formulae; $\gamma^*=\gamma_0 \exp (i\omega t)$ and $\sigma^*=\sigma_0 \exp \{i(\omega t+\delta)\}$, respectively.

When the above formula is introduced into the foregoing formula of complex elastic modulus G*=σ*/γ*, $$G^* = (\sigma_0/\gamma_0)\exp\delta$$
$$= (\sigma_0/\gamma_0)(\cos\delta + \sin\delta)$$

Herein, G*=G'+I G" is taken into account, resulting in the following formulae.

$$G'=(\sigma_0/\gamma_0) \cos \delta$$

$$G''=(\sigma_0/\gamma_0) \sin \delta$$

This means that elastic energy stored in a viscoelastic body in one cycle is proportional to G', and energy dissipated from a viscoelastic body as heat is proportional to G". In this regard, G' as a real part and G" as an imaginary part are designated as storage elastic modulus and loss elastic modulus, respectively.

A storage elastic modulus of toner usable in the present invention is determined via measurement as described in the following procedures. (1) 0.5 g of toner employing a compacting machine, and a pellet with a diameter of 1 cm. (2) the pellet is installed in a parallel plate having a diameter of 1 cm and a gap of 6 mm. (3) A temperature at a measured portion and a parallel plate gap are set to 120° C. and 3 mm, respectively. (4) The measured portion is heated up to 200° C. in an increasing temperature rate of 5° C./min to measure a complex viscoelasticity at any temperature. A strain angle was varied in the range of 0.05-5 degree. (5) In the above procedures, the storage elastic modulus of toner usable in the present invention is obtained via measurement at the following condition.

Measuring apparatus: MR-500 Soliquid meter (produced by Rheology Co.)

Frequency: 10 Hz

Plate diameter: 1.0 cm (parallel plate)
Gap: 3.0 mm
Strain angle: 0.05-5 degree
Measured temperature range: −20-200° C.

The toner of the present invention has a decline starting temperature of a storage elastic modulus of 10-40° C. The decline starting temperature of a storage elastic modulus is designated as a decline starting temperature at which the storage elastic modulus starts declining from the base line at a temperature of from −20° C. to 0° C.

As a method of adding the above storage elastic modulus to toner usable in the present invention, provided is a method in which 1-15% by weight of vinyl polymer is added into toner, as described below. The addition amount of this vinyl polymer is further preferably 5-10% by weight.

This vinyl polymer is oligomer in which a glass transition point is from −100° C. to 20° C., a peak molecular weight is 300-3400, and a molecular weight distribution is sharp-form-shaped, accompanied with 10-150° C. lower glass transition point, compared to that of binder resin.

A peak molecular weight of the vinyl polymer is 300-3400, preferably 800-2200, and more preferably 1000-1800. A ratio of weight average molecular weight to number average molecular weight (Mw/Mn) is 1.2-2.4, and preferably 1.4-1.9. In addition, weight average molecular weight Mw is 840-5200.

The above-described peak molecular weight, weight average molecular weight and number average molecular weight are measured employing-Gel permeation chromatography (GPC). The molecular weight determination with GPC is conducted using tetrahydrofuran as a solvent and columns which are 3-4 connected columns of Tskgel G2000 (exclusion limit: 10000, produced by TOSO Co., Ltd.).

The glass transition temperature of a vinyl polymer is from −100° C. to 20° C., preferably from −85° C. to 6° C., and more preferably from −80° C. to −20° C. The glass transition temperature and the endothermic peak temperature of toner can be measured by using a differential scanning calorimeter DSC-7 (manufactured by Perkin Elmer, Inc.) and TAC7/DX a thermal analysis controller TAC7/DX (manufactured by Perkin Elmer, Inc.). In addition, a liquid nitrogen unit is installed with the measuring apparatus for cooling.

The analysis procedure includes precise weighing a toner to be 4.5-5.0 mg to two places of decimals; enclosing the toner into an aluminum pan (Kit No. 0219-0041) and setting the pan on the DSC-7 sample-holder; and preparing a blank aluminum pan as a reference.

The measurement conditions are as follows: the measuring temperature range of from −150 to 50° C., the temperature increasing speed of 10° C./min. The temperature is controlled so as to be in 1st heating-1st cooling-2nd heating, and the glass transition temperature is calculated from a changing point in a baseline obtained in the 2nd heating via an onset temperature program.

Specific examples of a polymerizable polymer constituting the above vinyl polymer include acrylic acid ester such as butyl acrylate, dodecyl acrylate, octyl acrylate, 2-ethylhexyl acrylate or phenyl acrylate; and methacrylic acid ester such as octyl methacrylate or octyldodecyl methacrylate. Of these, butyl acrylate and 2-ethylhexyl acrylate are particularly preferable.

It is preferable in the present invention that toner having a glass transition point in the foregoing range is obtained by adding a vinyl polymer (homopolymer) formed via polymerization reaction by using one kind of the above-described polymerizable monomer, but a vinyl polymer as a copolymer may be allowed if a glass transition point of toner is within the foregoing temperature range. When the vinyl polymer is a copolymer, it is preferable that a weight ratio of butyl acrylate, 2-ethylhexyl acrylate or mixture thereof as a monomer component is at least 50% by weight of the vinyl polymer.

A vinyl polymer used in the present invention is one obtained through the following reaction process which is characterized by a method of supplying a polymeric monomer to a reaction kettle. Namely, polymerization of vinyl polymer is started under the condition that the reaction kettle is filled up with polymeric monomer first. Then, at an optional stage when the polymerization reaction has made progress, reactants generated in the reaction kettle (mixture of polymerized substances and unreacted polymeric monomers) are caused to pass through a volatile component separator to eliminate volatile components such as unreacted polymeric monomers from the reactants. After that, volatile components eliminated by the volatile component separator are returned again to the reaction kettle, and the polymerization reaction is further continued, thus, the vinyl polymer representing a final product is separated and taken out to be obtained.

As stated above, the vinyl polymer is one made under the condition wherein the reaction kettle is filled up with polymeric monomers and reaction products even on the way of the polymerization reaction, by starting the polymerization reaction under the condition that polymeric monomers are filled in a full capacity (100%) of the reaction kettle. Further, in the course of polymerization reaction of vinyl polymer, reactants in the reaction kettle (mixture of unreacted polymeric monomers and polymerized substances) are caused to pass through a volatile component separator at the right time to collect unreacted polymeric monomers in reactants, so that the unreacted polymeric monomers can be used for the polymerization reaction of the vinyl polymer.

FIG. 1 is a schematic diagram showing an example of a reactor used for polymerization of a vinyl polymer. In FIG. 1, the numeral 2 represents lines through which reaction components other than polymeric monomers such as initiators and solvents are supplied, 4 represents a stirring tank (reactor) in which a polymerization reaction is carried out, 6 represents a stirrer, 8 represents a recycled material supply line, 10, 14 and 15 represent delivery tubes, 12 represents a removal delivery tube, 16 represents a volatilizing device that lets reaction products pass through and eliminates and collects volatile components, 18 represents a polymeric monomer supply line, 20 represents a polymeric monomer supply tank and 22 represents a coagulator. Stirring tank (reactor) 4 can select appropriate reaction conditions for obtaining vinyl polymer of a desired type.

Polymeric monomers of a single type or plural types are supplied to stirring tank (reactor) 4 equipped with stirrer 6 through polymeric monomer supply line 18 from polymeric monomer supply tank 20, and reaction components such as free radical polymerization initiator and solvent are supplied to stirring tank (reactor) 4 through line 2, whereby, the polymerization reaction can be started. Polymerization started by heat is preferable, but the present invention is not limited to this. It is further possible to supply chain transfer agents to stirring tank (reactor) 4 through supply line 2.

Next, at the stage when the polymerization reaction has made progress to some extent, reactants are supplied to volatilizing device 16 from stirring tank (reactor) 4, for separating and eliminating vinyl polymer products and volatile components. Reactants are caused to pass through volatilizing device 16 so that volatile components are eliminated and collected, and vinyl polymer products are collected from delivery tube 15 for further processing, or as desired final products. Volatile components are compressed and distilled by coagulator 22, and are supplied again to stirring tank type reactor 4 from recycled material supply line 8 through delivery tubes 14 and 10. Or, volatile components are eliminated from the reaction system through removal delivery tube 12.

The toner of the present invention contains particles having a primary particle diameter of 40-800 nm as external additives. Herein, the primary particle diameter of external additives is represented by the number average primary particle diameter. 100 random particles are observed as the primary particle at a magnification of 10000 times employing a transmission electron microscope (TEM), and the number average primary particle diameter is determined by averaging the number after measuring the length in the Feret direction via image analysis.

It is a feature that the toners of the present invention are usable as external additives by adding particles such as organic or inorganic particles having a number average primary particle diameter of 40-800 nm. The toner of the present invention prepared via association in an aqueous medium can provide full color images accompanied with improved resolution with no "out of color registration" by using particles having a number average primary particle diameter of 40-800 nm as external additives. Those particles having a number average primary particle diameter of 50-200 nm are also preferably usable.

Inorganic oxide particles such as silica, titania, alumina and the like are preferably employed as the inorganic particles, and further these inorganic particles are preferably subjected to hydrophobic treatment employing a silane coupling agent or a titanium coupling agent. Strontium titanate, titanate and hydroxytalcite are also preferably employed. The degree of hydrophobic treatment is not specifically limited, but a range of 40-95 in methanol wettability is preferable. "Methanol wettability" means wettability measured against methanol. In this method, 0.2 g of targeted inorganic particles is weighed and added into 50 ml of distilled water charged into a 200 ml beaker. Methanol is slowly dripped from a burette, the top of which is immersed into the liquid, until the entire inorganic particles become wet while stirring slowly. The degree of hydrophobicity can be calculated by the following equation when the amount of methanol required to make inorganic particles completely wet is a m1.

$$\text{Degree of hydrophobicity}=[a/(a+50)]\times 100$$

Spherical organic particles are available as organic particles. Specifically, they are homopolymers and copolymers of styrene and methyl methacrylate.

The addition amount of particles having a primary particle diameter of 40-800 nm in the toner is 0.1-5.0% by weight, and preferably 0.5-4.0% by weight. Various particles other than particles having a primary particle diameter of 40-800 nm may be used in combination as external additives.

It is realized to improve flowability, a charging property, a cleaning ability and so forth via addition of such the external additives. Types of these external additives are not limited, and various inorganic particles, organic particles and lubricants can be utilized as external additives.

It is preferable that the shape of plural different color toners of the present invention has preferably an average value of circularity (shape factor) of 0.950-0.998, expressed by the following formula, when at least 2,000 toner particles are measured.

Circularity=(peripheral length of equivalent circle)/(peripheral length of toner projected image)=$2\pi\times$(particle projected area/$\pi)^{1/2}$/(peripheral length of toner projected image), where an equivalent circle means a circle having the same area as a toner projected image. The diameter of the equivalent circle means an equivalent circular diameter. In addition, the circularity is measured by FPIA-2000 produced by Sysmex Corporation, and the equivalent circular diameter is specified by the following formula.

Next, the manufacturing method of toner of the present invention will be described in detail.

The method of manufacturing toner including a process of associating or fusing resin particles in an aqueous medium is provided as a manufacturing method of plural different color toners (so-called plural different color polymerized toners) usable in the present invention. Examples of this method are described in Japanese Patent O.P.I. Publication No. 5-265252, Japanese Patent O.P.I. Publication No. 6-329947 and Japanese Patent O.P.I. Publication No. 9-15904, without being restricted thereto. To be more specific, a method in which a plurality of dispersed particles of the component materials such as a resin particle and a colorant, or of particles composed of a resin and a colorant is associated. Especially, after dispersing them in water using an emulsifier, a coagulant having a coagulation concentration in excess of the critical level is added thereto, and the process of salting-out is performed. At the same time, these substances are subjected to heating and fusing above the glass transition point temperature of the formed polymer itself, so that the particle size is gradually increased by growth while fused particles are formed. When the intended particle size has been reached, much water is added to suspend the increase of the particle size. Further heating and agitation are continued until the particle surface becomes smooth, and the shape is controlled. These particles in the moisture state are heated and dried in the fluid condition, whereby toner can be formed. In this case, it is possible to add an organic solvent as well as coagulant into water, wherein the organic solvent is subjected to infinite dissolution.

It is preferable that toner of the present invention is prepared by coagulating resin particles dispersed in an aqueous medium, and also prepared by coagulating resin particles containing colorants employing resin particles containing releasing agents. Resin particles are preferably prepared by a process in which polymer particles (resin particles) are formed by allowing a monomer to emulsion-polymerize in liquid (aqueous medium) having an added emulsifying solution. Since a particle size distribution of resin particles prepared via emulsion polymerization is almost close to be in monodispersity, resin particles showing small variations constantly in particle size distribution can be prepared, whereby dot latent images formed on a photoreceptor can be precisely reproduced to toner images. When toner is prepared by associating the resin particles via addition of an organic solvent and a coagulant, the resulting toner becomes a toner showing reduced variations between manufacturing lots, resulting in a constant level in properties. The foregoing "association" means that plural resin particles are fused with each other, including the case of the resin particles being fused with other particles (for example, colorant particles).

Coagulants usable during associating the foregoing resin particles in an aqueous medium are not limited, but those are preferably selected from metal salts. Specifically, examples of the monovalent metal include alkali metal salts of sodium, potassium, lithium and the like. Examples of the divalent metal include alkaline earth metal salts of calcium, magnesium and the like, as well as manganese and copper. Examples of the trivalent metal include metal salts of iron, aluminium and the like. Examples of specific salts include sodium chloride, potassium chloride, lithium chloride, calcium chloride, zinc chloride, copper sulfate, magnesium sulfate and manganese sulfate. These may be used in combination.

It is preferred that these coagulants having an amount higher than the critical coagulation concentration are added. The critical coagulation concentration, as described here, refers to an index regarding the stability of water based dispersion and to concentration at which coagulation occurs through the addition of coagulants. The critical coagulation concentration varies depending on the emulsified components and a dispersant itself.

The critical coagulation concentration is described in, for example, Seizo Okamura, et al., "Kobunshi Kagaku (Polymer Chemistry) 17, 601 (1960) edited by Kobunshi Gakkai, and other publications. Based on such publications, it is possible to obtain detailed critical coagulation concentration data. Further, as another method, a specific salt is added into a targeted particle dispersion while varying the concentration of the salt; the ξ potential of the resulting dispersion is measured, and the critical coagulation concentration is also determined as the concentration at which the ξ potential value varies.

The addition amount of coagulants usable as the toner in the present invention may be an amount higher than the critical coagulation concentration, but the addition amount is preferably at least 1.2 times that of the critical coagulation concentration, and more preferably at least 1.5 times.

Those solvents which do not dissolve a formed resin are selected as solvents infinitely soluble in water, used together with a coagulant. Specifically listed may be alcohols such as methanol, ethanol, propanol, isopropanol, t-butanol, ethoxyethanol and buthoxy ethanol; nitrites such as acetonitrile and the like; and ethers such as dioxane and the like. Particularly, ethanol, propanol and isopropanol are preferable.

The addition amount of the infinitely soluble solvents in this water is preferably 1-100% by volume, based on the polymer-containing dispersion into which coagulants are added.

In order to uniform the particle shape, colored particles (original type toners) are produced by associating resin particles in an aqueous medium, and a slurry containing at least 10% by weight of water, based on the colored particle, is preferably fluid-dried after filtrating the colored particle dispersion.

The suspension polymerization method will be described as an example of a manufacturing method of toner usable in the present invention. A colorant and, if desired, releasing agent and charge controlling agent as well as polymerization initiator are added into a polymerizable monomer. Various component materials are dissolved or dispersed into the polymerizable monomer employing a homogenizer, a sand mill, a sand grinder, or an ultrasonic pulverizer. The polymerizable monomer with these component materials dissolved or dispersed therein is dispersed into oil drops having a desired size as toner in the aqueous medium containing a dispersion stabilizer, employing a homomixer or a homogenizer. After this, the polymerizable monomer is moved into the reactor whose agitation mechanism is composed of the agitation blade (to be described later) and is heated therein, or a water-soluble polymerization initiator is added into the resulting dispersion (referred to also as mini-emulsion polymerization) to promote the polymerization reaction. After this reaction, the dispersion stabilizer is removed and the polymerizable monomer is filtered, cleaned and dried to prepare toner of the present invention. Functional materials such as a sufficient amount of releasing agents can be introduced into formed resin particles or coated layers, since the mini-emulsion method is different from a conventional emulsion polymerization method, and releasing agents dissolved in a oil phase are not comparatively eliminated.

In addition, "aqueous medium" of the present invention means an aqueous medium containing at least 50% by weight of water.

Examples of a polymerizable monomer constituting the resin include: styrenes, for example, styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, a p-n-nonylstyrene, p-n-decylstyrene, and p-n-dodecyl styrene, and derivatives thereof; methacrylate derivatives, for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives, for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins, for example, ethylene, propylene, and isobutylene; halogen-containing vinyls, for example, vinyl chloride, vinylidene chloride, vinyl bromide, and vinyl fluoride and vinylidene fluoride; vinyl esters, for example, vinyl propionate, vinyl acetate and vinyl benzoate; vinyl ethers, for example, vinyl methyl ether and vinyl ethyl ether; vinyl ketones, for example, vinyl methyl ketone, vinyl ethyl ketone and vinyl hexyl ketone; N-vinyl compounds, for example, N-vinylcarbazole, N-vinyl indole, and N-vinyl pyrrolidone; vinyl compounds, for example, vinyl naphthalene and vinyl pyridine; and acrylic acid or methacrylic acid derivatives, for example, acrylonirile, methacrylonitrile and acrylamide. These vinyl monomers may be used singly or used in combination.

Further, polyfunctional vinyls may be used to form a resin having a cross-linking structure, employing examples of the polyfunctional vinyl including: divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

Polymerizable monomers having an ionic dissociative group as the polymerizable monomer constituting the resin, for example, are those having a carboxyl group, a sulfonic acid group and a phosphate group as the composition group of a monomer. Those monomers can be used in combination with acrylic acid, methacrylic acid, maleic acid, itaconic acid, cinnamic acid, fumaric acid, maleic acid mono-alkyl ester, itaconic acid mono-alkyl ester, styrene sulfonic acid, allylsulfosuccinic acid, 2-acrylamide-2-methylpropanesulfonic acid and acid phosphoxyethyl methacrylate, but when these ionic dissociative groups remain on the toner surface, toner contamination on the a-Si photoreceptor surface is easy to be generated, and out-of-focus dot latent images on the photoreceptor are also easy to be generated, whereby the reproduction of toner images is easy to be degraded. A polymerizable toner containing no polymerizable monomer having an ionic dissociative group is preferable as toner of the present invention. A polymerizable toner of the present invention means a toner in which a binder resin for toner and a toner shape are formed via polymerization of raw material monomer used for the binder resin as well as subsequent chemical treatment, if desired. Specifically, it means a toner formed via suspension polymerization and emulsion polymerization, as well as a subsequent particle-to-particle fusing process carried out if desired.

These polymerizable monomers can be polymerized employing a radical polymerization initiator. In this case, an oil-soluble polymerization initiator can be employed in the suspension polymerization.

Preferably employed is a water-soluble radical polymerization initiator. Examples of the water-soluble radical polymerization initiator include persulfate salts such as potassium persulfate, ammonium persulfate and the like, azobisaminodipropane acetate salt, azobiscyano valeric acid and salts thereof, and hydrogen peroxide.

The oil-soluble polymerization initiator can be used in a suspension polymerization method. Examples of the oil-soluble polymerization initiator include: azo or diazo polymerization initiators, such as 2,2'-azobis-(2,4-dimethylvaleronitrile), 2,2'-azobis-isobutyronitrile, 1,1'-azobis-(cyclohexane-1-carbonitrile), 2,2'-azobis-4-methoxy-2,4-dimethylvaleronitrile and azobisisobutyronitrile; and peroxide polymerization initiators or polymer polymerization initiators having a peroxide group as a side chain such as benzoyl peroxide, methyl-ethyl-ketone peroxide, diisopropyl peroxycarbonate, cumene hydroperoxide, t-butyl hydroperoxide, di-t-butyl peroxide, dicumyl peroxide, 2,4-dichloro benzoyl peroxide, lauroyl peroxide, 2,2-bis-(4,4-t-butyl peroxycyclohexyl)propane and tris(t-butyl peroxy)triazine.

Examples of dispersion stabilizers include tricalcium phosphate, magnesium phosphate, zinc phosphate, aluminum phosphate, calcium carbonate, magnesium carbonate, calcium hydrate, magnesium hydrate, aluminum hydrate, calcium metasilicate, calcium sulfate, barium sulfate, bentonite, silica and alumina. Further, polyvinyl alcohol, gelatin, methylcellulose, sodium dodecylbenzene sulfonate, an ethyleneoxide adduct and high alcohol sodium sulfate, which are commonly usable as surfactants, can also be utilized as dispersion stabilizers.

Known inorganic or organic colorants are usable as the colorant of the present invention. Specific colorants are listed below.

As a black colorant, for example, carbon blacks such as furnace black, channel black, acetylene black, thermal black, and lampblack, and also the magnetic powders such as magnetite and ferrite are usable.

The following colorants are also provided as colorants usable for the chromatic color toner.

Provided are the following colorants used for the toner in which reflectance at not less than 380 nm and less than 500 nm, or at not less than 600 nm and less than 730 nm is relatively higher than that at not less than 500 nm and less than 600 nm, or reflectance at not less than 600 nm and less than 730 nm is relatively higher than that at not less than 380 nm and less than 600 nm. Examples of the above include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Provided are the following colorants used for the toner in which reflectance at not less than 500 nm and less than 730 nm is relatively higher than that at not less than 380 nm and less than 500 nm. Examples of the above include C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, and C. I. Pigment Yellow 138.

Provided are the following colorants used for the toner in which reflectance at not less than 500 nm and less than 600 nm is relatively higher than that at not less than 380 nm and less than 500 nm, or at not less than 600 nm and less than 730 nm, reflectance at not less than 380 nm and less than 500 nm is relatively higher than that at not less than 500 nm and less than 730 nm, or reflectance at not less than 380 nm and less than 600 nm is relatively higher than that at not less than 600 nm and less than 730 nm. Examples of the above include pigments such as C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62 and C. I. Pigment Blue 66, phthalocyanine compounds such as copper tetra-(α-hydroxyethoxy)phthalocyanine and so forth, and anthraquinone derivatives such as ORACET blue 2R (produced by Ciba geigy Ltd.).

Incidentally, these colorants may be used singly or be used in combination of at least two of them, if desired. The addition amount of the colorant is set to 1-30% by weight, and preferably in the range of 2-20% by weight, based on the total weight of the toner.

A process of coloring polymers by adding polymer particles prepared by a emulsion polymerization method at the coagulation stage of adding a coagulant, and a process of producing colored particles via addition and polymerization of colorants at the stage of polymerizing monomers are usable as the addition method of colorants. In addition, it is preferable that colorants are utilized by treating the surface with a coupling agent or such, so as not to deteriorate radical polymerization, when the colorants are added at the stage of preparing polymers.

Commonly known wax is provided as the wax usable for toner of the present invention. Examples of the above usable wax include polyolefin wax such as polyethylene wax or polypropylene wax; long chain hydrocarbon based wax such as paraffin wax or sasol wax; dialkylketone based wax such as distearylketone or such; ester based wax such as carnauba wax, montan wax, trimethylolpropane tribehenate, pentaerythritol tetramyristate, pentaerythritol tetrastearate, pentaerythritol tetrabehenate, pentaerythritol diacetatedibehenate, glycerintribehenate, 1,18-octadecanediol distearate, trimellic acid tristearyl or distearyl maleate; and amido based wax such as ethylenediamine dibehenylamido or trimellic acid tristearylamido.

The melting point of wax is commonly 40-160° C., preferably 50-120° C., and more preferably 60-90° C. When the melting point is set within the above range, not only heat resistance storage stability of toner is obtained, but also stable toner image formation can be conducted with no occurrence of cold off-setting in the case of fixing at low temperature. Further, the wax content in toner is preferably 1-30% by weight, and more preferably 5-20% by weight.

Similarly to a charge controlling agent, commonly known water-dispersible agents are usable. Examples of the above include a nigrosin based dye, a metal salt of a naphthenic acid or a higher fatty acid, azo based metal complex, a disalicylic acid, and a dibenzyl acid salt or a metal complex thereof.

Incidentally, it is preferable that number average primary particle size under dispersion for these charge controlling agents and wax is made to be 200-900 nm.

(Description of an Image Forming Apparatus)

Next, the structure of the image forming apparatus used for a color image forming method in the present invention will be described. In the image forming method in the present invention, plural photoreceptors are charged electrically, then, each surface of the photoreceptor thus charged is exposed to light to form an electrostatic latent image, and color toners corresponding respectively to electrostatic latent images in respective colors are used to form a color toner image. Color toner images formed on the photoreceptor are transferred onto a recording material or onto an intermediate image transfer material to be superimposed, and a toner image formed on the recording material is fixed, thus, a full-color image is formed.

Figure 2:
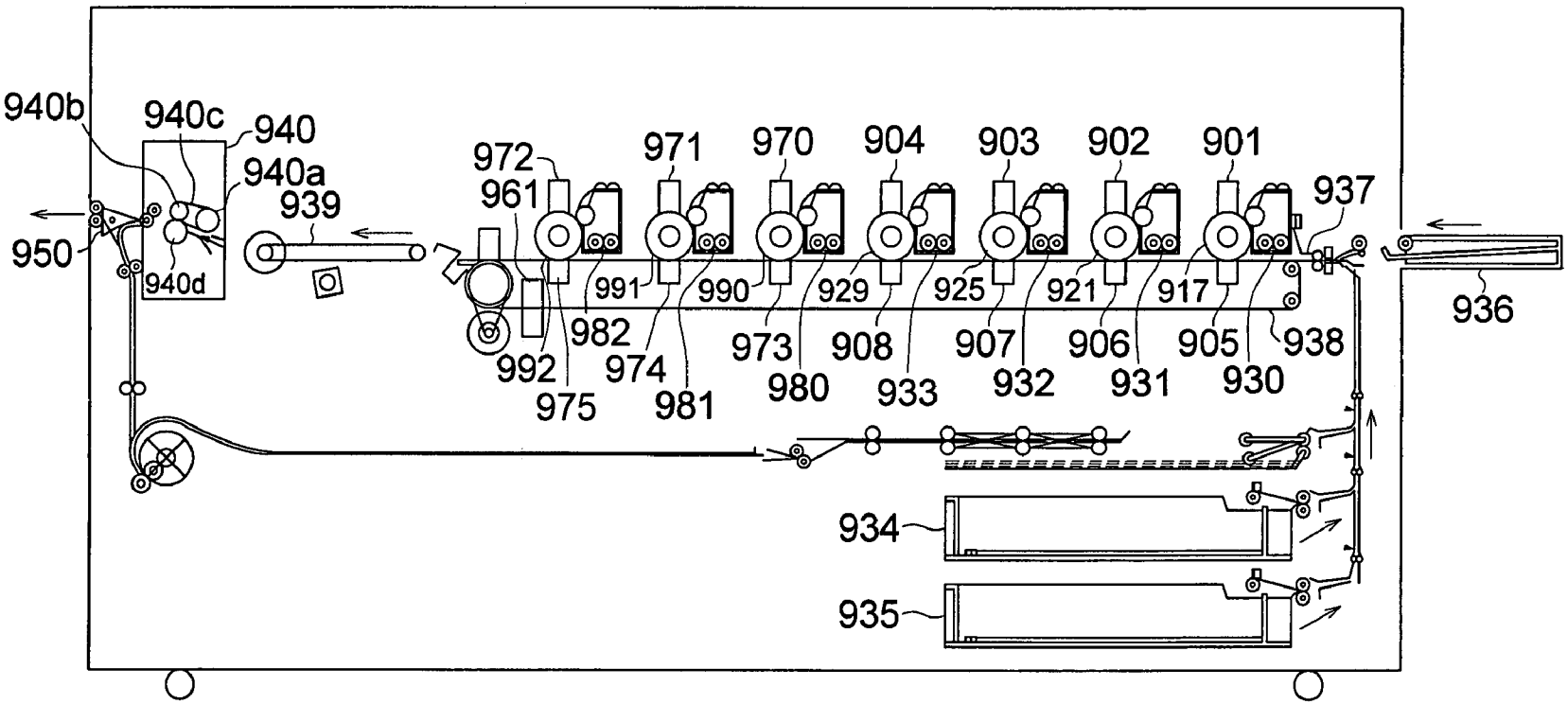
FIG. 2 is a schematic cross-sectional view showing a seven color tandem system image forming apparatus, and FIG. 3 a schematic cross-sectional view showing another example of an image forming apparatus using seven color toners.

FIG. 2 is FIG. 2 is a schematic cross-sectional view showing a seven color tandem system image forming apparatus that is a typical example of an image forming apparatus usable for a color image forming method in the present invention. The image forming apparatus shown in FIG. 2 is equipped with image forming units which respectively conduct toner image forming by using toner wherein reflectance at not less than 500 nm and less than 730 nm is relatively higher than that at not less than 380 nm and less than 500 nm, toner wherein reflectance at not less than 380 nm and less than 500 nm or not less than 600 nm and less than 730 nm is relatively higher than that at not less than 500 nm and less than 600 nm, toner wherein reflectance at not less than 380 nm and less than 600 nm is relatively higher than that at not less than 600 nm and less than 730 nm, toner wherein reflectance at not less than 600 nm and less than 730 nm is relatively higher than that at not less than 380 nm and less than 600 nm, toner wherein reflectance at not less than 500 nm and less than 600 nm is relatively higher than that at not less than 380 nm and less than 500 nm, or not less than 600 nm and less than 730 nm, toner wherein reflectance at not less than 380 nm and less than 500 nm is relatively higher than that at not less than 500 nm and less than 730 nm, and black toner.

In the figure, each of numerals 901, 902, 903, 904, 970, 971 and 972 represents a charging device (charging means), and each charging device charges evenly each of photosensitive drums 917, 921, 925, 929, 990, 991 and 992. Each of seven laser beams emitted respectively from unillustrated semiconductor lasers scans a surface of each of photosensitive drums 917, 921, 925, 929, 990, 991 and 992 which are evenly charged by respective charging devices.

On the other hand, the numeral 930 represents a developing device (developing means) to which the toner wherein reflectance at not less than 500 nm and less than 730 nm is relatively higher than that at not less than 380 nm and less than 500 nm is supplied, and it forms an image of the aforesaid toner on photosensitive drum 917 following the laser beam (shown with broken lines in the drawing). The numeral 931 represents a developing device to which the toner wherein reflectance at not less than 380 nm and less than 500 nm and at not less than 600 nm and less than 730 nm is relatively higher than that at not less than 500 nm and less than 600 nm is supplied, and it forms an image of the aforesaid toner on photosensitive drum 921 following the laser beam (shown with broken lines in the figure). The numeral 932 represents a developing device to which the toner wherein reflectance at not less than 380 nm and less than 600 nm is relatively higher than that at not less than 600 nm and less than 730 nm is supplied, and it forms an image of the aforesaid toner on photosensitive drum 925 following the laser beam (shown with broken lines in the drawing).

The numeral 933 represents a developing device (developing means) to which the toner wherein reflectance at not less than 600 nm and less than 730 nm is relatively higher than that at not less than 380 nm and less than 600 nm is supplied, and it forms an image of the aforesaid toner on photosensitive drum 929 following the laser beam (shown with broken lines in the drawing). The numeral 980 represents a developing device to which the toner wherein reflectance at not less than 500 nm and less than 600 nm is relatively higher than that at not less than 380 nm and less than 500 nm or at not less than 600 nm and less than 730 nm is supplied, and it forms an image of the aforesaid toner on photosensitive drum 990 following the laser beam (shown with broken lines in the drawing). The numeral 981 represents a developing device to which the toner wherein reflectance at not less than 380 nm and less than 500 nm is relatively higher than that at not less than 500 nm and less than 730 nm is supplied, and it forms an image of the aforesaid toner on photosensitive drum 991 following the laser beam (shown with broken lines in the drawing). The numeral 982 represents a developing device to which black toner is supplied, and it forms an image of the aforesaid toner on photosensitive drum 992, following the laser beam (shown with broken lines in the drawing).

As stated above, six toner images each having a different chromatic color and a different reflectance spectrum, and a black toner image which are formed on respective photosensitive drums are transferred onto a sheet, and thereby, a full-color outputted image is obtained.

A sheet fed out of any one of sheet cassettes 934 and 935 as well as manual bypass tray 936 is attracted to transfer belt 938 through registration roller 937 to be transported. Then, in synchronization with sheet feed timing, toner images each having a different color are developed on respective photosensitive drums 917, 921, 925, 929, 990, 991 and 992 in advance, and these toner images are transferred onto the sheet by the transfer processes for respective colors (composed of transfer belt 938 and transfer electrodes 905, 906, 908, 973, 974 and 975) at their positions.

After the transfer of the toner images onto the sheet, toner remaining on the photoreceptor may be removed by installing a cleaning device for exclusive use to remove toner such as a leaning blade. However, for the purpose of avoiding a large size of the total image forming apparatus by making the image forming unit to be compact, it is preferable to employ the structure wherein the residual toner on the photoreceptor is collected and the cleaning device for exclusive use is omitted (namely, non-cleaning device image forming unit). With respect to toner used in the present invention, physical properties of each toner particle are homogenized, whereby, residual toner can be effectively collected.

The sheet onto which toner images each having a different color are transferred is separated from transfer belt 938 to be conveyed by conveyance belt 939, and toner images are fixed on the sheet by fixing device (fixing means) 940. The sheet which has emerged from fixing device 940 is guided downward temporarily by flapper 950, then, after the trailing edge of the sheet has passed through flapper 950, the sheet switchbacks to be ejected with its surface facing downward. Therefore, when original images composed of a plurality of pages are printed sequentially from the leading page, a group of sheets in ascending sequence can be obtained.

Fixing means 940 mentioned above employs belt fixing, which is of the structure having therein heat roller 940*a* having a heating means by a halogen lamp, supporting roller 940*b* that is arranged to be away from and to be in parallel with heat roller 940*a*, fixing belt 940*c* that is trained about heat roller 940*a* and supporting roller 940*b* and pressure roller 940*d* that is in pressure contact with supporting roller 250 through fixing belt 940*c* to form a nip portion.

A fixing means of a belt fixing type can be used as a fixing means of the image forming apparatus used for the color image forming method relating to the present invention. Compared with roller fixing, the belt fixing can fix minute dot images without disturbing them because it fixes toner images under soft pressure force, and it is a preferable fixing method for expressing halftone color images to be in sufficient tones.

In the meantime, it is possible to arrange seven photosensitive drums 917, 921, 925, 929, 990, 991 and 992 at even intervals and to convey the sheet on conveyance belt 939 at a constant speed. As a result, the unillustrated semiconductor lasers mentioned earlier can be synchronized with the aforesaid timing to be driven for each color.

An image forming apparatus used for the color image forming method relating to the present invention forms a color image with high image quality, and as a light source for image-wise exposure for the image forming apparatus (color printer) of this kind, a short-wavelength light source such as a semiconductor laser can be used, because high density dot latent images are formed on the aforesaid photoreceptor. In particular, semiconductor lasers whose wavelength is in a range of 380-530 nm are preferable, and if these short-wavelength light sources are used, a diameter of an exposure beam can be narrowed down to 30 μm or less, thus, high density dot latent images can be formed on the photoreceptor.

A beam emitted from the aforesaid light source shows a circular-shaped or oval-shaped luminance distribution that approximates the normal distribution in which bottom portions expand from side to side, and in the case of a laser beam, for example, it is generally possible to form, on a photoreceptor, a beam having a circular shape or an oval shape which is as extremely small as 6-30 μm in one of the main scanning direction and the sub-scanning direction, or in both directions.

Figure 3:
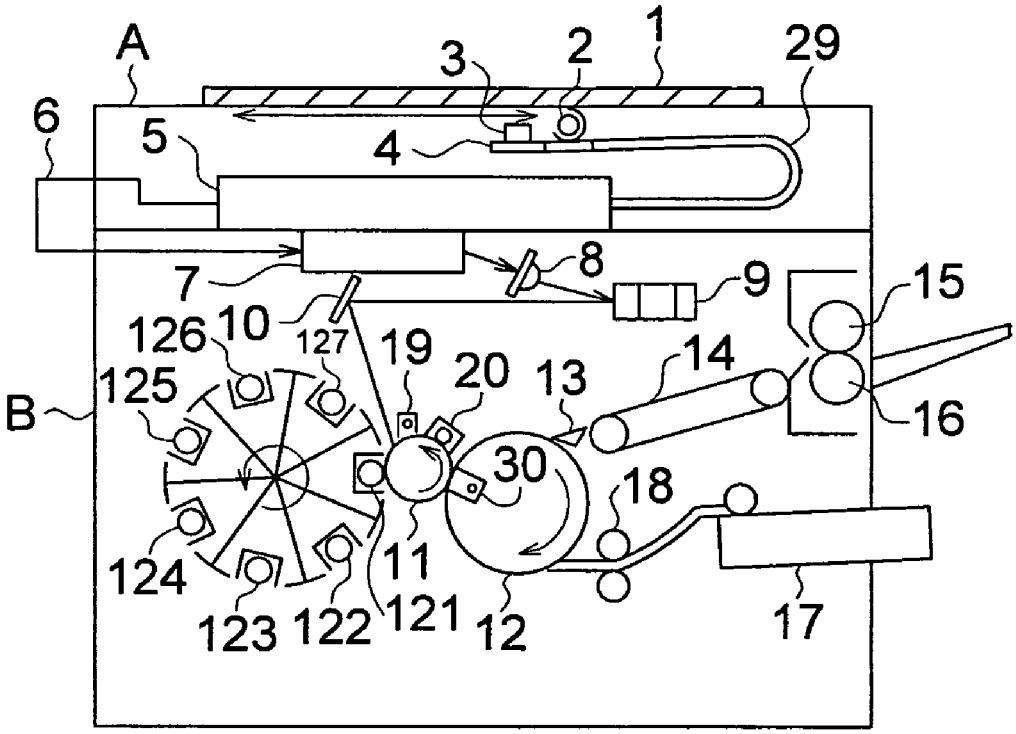

FIG. 3 a schematic cross-sectional view showing another example of an image forming apparatus using seven color toners. The image forming apparatus shown in FIG. 3 is one wherein a color original is subjected to color separation by a conventional color image sensor for each pixel, to be read digitally as electric signals, and a full-color print image is obtained through an electrophotographic process on a color laser beam printer section. The image forming apparatus is equipped with image reading section A and image printing section B.

In image reading section A, color original 1 placed on a platen for an original is illuminated by original exposure lamp 2, and a color reflected light image reflected from the color original is formed on color image sensor 3 that moves in parallel with an original for scanning.

Color image signals resulted from color separation conducted by color image sensor 3 for each pixel are subjected to signal processing by color signal processing circuit 4, and are inputted in image processing circuit 5 through cable 29. In image processing circuit 5, digital image processing is sent out to image printing section B after digitalization of input signals is conducted and color information is separated by digital image processing of color signals. Depending on image data sent out to printing section B through cable 6, semiconductor laser 8 is modulated from semiconductor laser drive section 7, to be reflected on polygon mirror 9, and to be further reflected on mirror 10, then, a single-color latent image subjected to color separation in a raster form is formed on photosensitive drum 11 representing an image carrier that is charged evenly by primary charging device 19.

The latent image thus formed is visualized in seven developing devices including magenta developing device 121, cyan developing device 122, yellow developing device 123, red developing device 124, blue developing device 125, green developing device 126 and black developing device 127, and color-separated toner images are formed on photosensitive drum 11.

On the other hand, a transfer material supplied from cassette 17 is wound round transfer drum 12 through electrostatic adsorption, after the leading edge of the image on the transfer material is adjusted by registration roller 18 in terms of timing, and a toner image is transferred by transfer charging device 30 in synchronization with the aforesaid color separation toner image.

As is apparent from the drawing, a single image forming process forms only one image of a single color, whereby, the color separation process for the original needs to be repeated seven times that is equivalent to the number of toner colors and processes of latent image forming, development and transfer corresponding to each color component are repeated, in synchronization with respective color separations in the same way.

In the aforesaid manner, the transfer material makes seven turns to complete transfers for seven colors while winding round transfer drum 12, and then, is exfoliated from transfer drum 12 forcibly by separation claw 13, and is guided to heat-pressure-fixing rollers 15 and 16 through conveyance member 14 to be ejected out of the apparatus after toner images for plural colors on the transfer material are fixed. Through the aforesaid respective processes, full-color copying processes for one sheet are completed. Meanwhile, residual toner on photosensitive drum 11 is eliminated by cleaner 20.

A glossy coated paper and a non-glossy paper representing a typical sheet for offset printing which can be used for the image forming method relating to the present invention will be explained as follows.

A surface of glossy coated paper for offset printing is requested to have high hydrophilic property for accelerating wet by immersion water used in the course of printing. Further, resin emulsions such as wax having a melting point of 100-160° C. and polyacrylamide are coated on a sheet support so that fibers and fillings may not be exfoliated from the sheet surface even when the sheet gets wet with water.

In the case of a glossy coated paper manufactured by a cast method (method for manufacturing glossy coated paper by pressing a sheet against a cylinder surface that is mirror finished while the coating material coated on the base paper is in the half-dried state), those having the structure wherein two or more electron-beam curable resin covered layers are laminated are typical. In the glossy coated paper of this kind, a cured object that is formed by radiating electron-beam curable resin composite containing no colorant with electron beam is used for an inner resin covered layer, while, a cured object that is formed by radiating electron-beam curable resin composite containing colorant with electron beam is used for an outer resin covered layer. The glossy coated paper has high whiteness, and superior makeup is excellent.

On the other hand, a surface of non-glossy paper for offset printing is requested to have high hydrophilic property for accelerating wet by immersion water used in the course of printing, which is the same as the glossy coated paper. Further, an agent that is called paper strength agent and gives strength to the sheet is used, so that fibers and fillings may not be exfoliated from the sheet surface even when the sheet gets wet.

Polyacrylamide is usually used as a paper strength agent, and depending on its ionic properties, there exist anionic polyacrylamide, cationic polyacrylamide and amphoteric polyacrylamide. Main methods of adding paper strength agents include an individual addition method to add cationic polyacrylamide or amphoteric polyacrylamide to pulp slurries individually and a combined addition method to add anionic polyacrylamide and cationic polyacrylamide to pulp slurries respectively.

There is also available non-glossy paper whose non-destructive strength is improved by making paper by the use of paper-making additives wherein acrylamide monomer, vinyl monomer having anionic group and vinyl monomer having cationic group if necessary are co-polymerized.

Further, there is available non-glossy paper on which starch of polyvinyl alcohol is coated as a paper strength agent. Incidentally, when using polyvinyl alcohol as a paper strength agent, if polyvinyl alcohol content in a coating solution is made to be 50% by weight or more, and if a coating solution to which 10-10,000 ppm of penetration agents such as polyglycol type nonionic surfactants are added is used, an excellent non-glossy paper is obtained.

The basis weight of paper is also 64-150 g/m$^2$.

EXAMPLE

Next, the present invention will be explained employing examples, but the present invention is not limited thereto.

1. Preparation of Developer (Toner)

<Preparation of Vinyl Polymer Contained in Toner>

Butylacrylate (BA) was maintained at a constant temperature, and supplied to a continuous-stirring tank type reactor.

The reaction zone weight and the supplying flow rate were controlled so that 100% of the usable volume of the continuous-stirring tank type reactor was filled with a polymerizable monomer and reactants, and the average retention time was kept constant within the range of 10-15 min. Retention was adjusted so that the frequency of circulation was 30-40 times. The reaction temperature of the continuous-stirring tank type reactor was kept constant within a range of 175-240° C. The reaction product was continuously transferred via a pump to the volatile removing zone. A polymer product obtained from the volatile removing zone was continuously sampled to measure a peak molecular weight and a glass transition point, and extracted as a product material through conduit 15. Thus the resulting vinyl polymer was designated as "vinyl polymer 1".

<Preparation of Resin Particle (s1) for Surface Formation>

Resin particle dispersion (S1) containing resin particle (s1) to form the toner surface via adhesion to the mother particle surface was prepared in the following procedures.

First, the following polymerizable monomers are mixed to prepare polymerizable monomer mixed solution (1).

| | |
|---|---|
| Styrene | 70.1 g |
| n-Butylacrylate | 19.9 g |
| Methacrylic acid | 10.9 g |

A separable flask equipped with a stirrer, a thermal sensor, a cooling pipe and a nitrogen feeding unit was employed, and the interior of the flask was heated to 80° C. while stirring under the nitrogen flow to prepare a surfactant solution obtained by dissolving 7.08 g of an anionic surfactant $C_{12}H_{25}OSO_3Na$ in 3,010 g of ion-exchange water. Added to this surfactant solution was an initiator solution prepared by dissolving 9.2 g of a polymerization initiator (potassium persulfate: KPS) in 200 g of ion-exchange water. After raising the temperature to 75° C., the foregoing polymerizable monomer mixed solution was dripped spending one hour. After terminating the dripping, the resulting system was heated and kept constant at 75° C. spending 2 hours to prepare resin particles via polymerization (first stage polymerization) while stirring. This resin particle had a peak molecular weight of 35000, and a median particle diameter of 62 nm in terms of volume.

<Preparation of Mother Particle m1>

(1) Preparation of Resin Particles

Next, resin particle m1 for mother particle was prepared via two stage polymerization processes. Added to the following polymerizable monomer mixed solution, in a flask fitted with a stirrer, was 93.8 g of pentaerythritol behenic acid ester and 60.0 g of the foregoing vinyl polymer 1, and was dissolved while heated to 80° C. to prepare polymerizable monomer mixed solution (3).

| | |
|---|---|
| Styrene | 186.9 g |
| n-Butylacrylate | 76.5 g |
| Methacrylic acid | 19.8 g |

On the other hand, in a separable flask equipped with a stirrer, a thermal sensor and a cooling pipe, 4.9 g of anionic surfactant ($C_{12}H_{25}(OCH_2CH_2)OSO_3Na$) was dissolved in 1364 g of ion-exchange water to prepare a surfactant solution. After heating the above surfactant solution to 80° C., it was mixed with polymerizable monomer solution (3). The resulting mixture was dispersed for two hours employing a mechanical type homogenizer "CLEARMIX" (produced by M Technique) having a circulation channel to prepare a emulsion dispersion containing emulsified particles (oil droplets) having a particle diameter of 750 nm.

Next, 1026 g of ion-exchange water was added into this emulsion dispersion, and thereafter 2.88 g of n-octanethiol and an initiator solution in which 9.8 g of polymerization initiator solution (potassium persulfate: KPS) was dissolved in 381 g of ion-exchange water were added. The resulting system was heated and polymerized at 80° C. while stirring for 1.5 hours (first stage polymerization) to obtain resin particles. These particles are designated as "resin particle A for mother particle".

The initiator solution in which 3.51 g of polymerization initiator solution (KPS) was dissolved in 137 g of ion-exchange water was added into a solution containing this "resin particle A for mother particle", and the following polymerizable monomer mixed solution was dripped at 80° C. spending 80 minutes.

| | |
|---|---|
| Styrene | 213.8 g |
| n-Butyl acrylate | 69.4 g |
| n-octanethiol | 4.55 g |

After dripping was terminated, polymerization (second stage polymerization) was conducted while stirring at 80° C. for two hours. Thereafter, the resulting mixture was cooled to 28° C. to prepare a dispersion of "resin particle B for mother particle"

(2) Coagulation of colorant particles and resin particles for mother particle. Colorant particles and resin particles for mother particle were coagulated by using colorant dispersion C prepared in procedures described below, and the above resin particle B for mother particle.

First, 280.0 g of C.I. Pigment Blue 15:1 was gradually added while stirring a solution in which 59.0 g of anionic surfactant ($C_{12}H_{25}(OCH_2CH_2)OSO_3Na$) was added into 1600 g of ion-exchange water, and dispersion treatment was conducted employing the foregoing "CLEARMIX" (produced by M Technique) to prepare colorant dispersion C.

Charged into a four-necked flask equipped with a thermal sensor, a cooling pipe, a nitrogen feeding unit and a stirrer were 237.2 g (in terms of solids) of resin particle B for mother particle, 2064 g of ion-exchange water, and 82 g of colorant dispersion C while stirring, and the inner temperature of the tank was set to 30° C.

The pH was adjusted to 10 via addition of a 5 mol/liter aqueous sodium hydroxide solution.

Subsequently, while stirring, added was an aqueous solution prepared by dissolving 40.4 g of magnesium chloride hexahydrate in 40.4 g of ion-exchange water spending 10 minutes. After standing for three minutes, the resulting system was heated to 85° C. spending 60 minutes, and resin particle (B) for mother particle was coagulated with colored particles to prepare mother particle m1.

While heating and stirring, the particle diameter of mother particle m1 was measured employing Multisizer 3 (produced by Beckmann Coulter Co.), and when the median particle diameter in terms of volume reached 5.5 μm, particle growth was suppressed via addition of an aqueous solution prepared by dissolving 5.1 g of sodium chloride in 20 g of ion-exchange water.

Glass transition point Tgm of resulting mother particle m1 was measured similarly to resin particle for the surface s1. The molecular weight was determined employing a GPC (gel permeation chromatography) apparatus. The results showed that a peak molecular weight was obtained at a molecular weight of 15000, while the weight average molecular weight was 22000.

<Preparation of Colored Particle 11>

The pH was adjusted to 8 by adding a 5 mol/liter aqueous sodium hydroxide solution into dispersion (S1) of resin particle for the surface. The ζ potential of dispersion (S1) of resin particle for the surface was −49.4 mV.

On the other hand, mother particle dispersion M1 prepared via the foregoing coagulation process was stirred for about one hour while heated. When circularity reached 0.936, resin particle dispersion S1 for the surface was added to fuse resin particle s1 on the mother particle m1 surface. Thereafter, added was an aqueous solution prepared by dissolving 96.3 g of sodium chloride in 385 g of ion-exchange water, and upon further decreasing the coagulation force of particles, stirring was continued at 85° C. for additional two hours to complete fusing of resin particle s1 to mother particle m1. Further, when circularity reached 0.956, while continuing to stir and heat, cooling was conducted down to 30° C. at a rate of 8° C./minute. The pH was adjusted to 2 via addition of hydrochloric acid, and stirring was terminated to obtain a dispersion of colored particle 11. The particle diameter of colored particle 11 was measured employing the foregoing Multisizer 3 (produced by Beckmann-Coulter Co.), resulting in a median diameter of 5.5 μm in terms of volume.

<Washing/Drying Process>

The resulting dispersion of colored particle 11 was separated by a basket type centrifugal separator Mark III type No. 60×40 manufactured by Matsumoto Kikai Mfg. Co. Ltd. to form a wet cake of the toner base material. The wet cake was washed in 40° C. ion exchange water employing the above basket type centrifugal separator until separated liquid reached 5 μS/cm in electrical conductivity, and then moved to Flash Jet Dryer produced by Seishin Kigyo Co, Ltd. and dried until the moisture content was reduced by 0.5% by weight, to prepare colored particle 11.

<Preparation of Colored Particles 12-17>

Colored particle 12 was prepared similarly to preparation of colored particle 11, except that 280.0 g of C. I. Pigment Blue 15:1 employed in preparation of colored particle 11 was replaced by 420 g of C. I. Pigment Red 122.

Colored particle 13 was prepared similarly to preparation of colored particle 11, except that 280.0 g of C. I. Pigment Blue 15:1 employed in preparation of colored particle 11 was replaced by 420 g of C. I. Pigment Yellow 74.

Colored particle 14 was prepared similarly to preparation of colored particle 11, except that 280.0 g of C. I. Pigment Blue 15:1 employed in preparation of colored particle 11 was replaced by 420 g of neutral carbon black "REGAL 660", produced by Cabot Co., Ltd.

Colored particle 15 was prepared similarly to preparation of colored particle 11, except that 280.0 g of C. I. Pigment Blue 15:1 employed in preparation of colored particle 11 was replaced by 420 g of C. I. Pigment Red 112.

Colored particle 16 was prepared similarly to preparation of colored particle 11, except that 280.0 g of C. I. Pigment Blue 15:1 employed in preparation of colored particle 11 was replaced by 420 g of copper tetra-(α-hydroxyethoxy)phthalocyanine.

Colored particle 17 was prepared similarly to preparation of colored particle 11, except that 280.0 g of C. I. Pigment Blue 15:1 employed in preparation of colored particle 11 was replaced by 420 g of an anthraquinone derivative ORACET blue 2R (produced by Ciba geigy Ltd.).

Colored particles 11-17 for 7 colors were prepared in this way.

<Addition of External Additives (Preparation of Toner 1)>

The hydrophobic silica having a number average primary particle diameter of 150 nm was added into above-described colored particles 11-17 employing a HENSCHEL MIXER (Produced by Mitsui Miike Chemical Engineering Co., Ltd.) with a circulation speed of a rotational stirring blade of 30 m/sec, and mixed for 25 min. Thereafter, large particles were sieved away with a sieve of 45 μm mesh to prepare 7 color toner 1 (11.12, 13, 14, 15, 16 and 17) made of colored particle 1 (11-17).

The variation of reflectance at 380-730 nm relating to the resulting toner was evaluated via measured reflection spectrum by the foregoing measuring method employing the foregoing reflection spectroscopy meter GretagMcbeth SpectroScan (produced by Gretag Macbeth). The results are shown in Table 1. A word "large" shown in each range in Table 1 means that there is a maximum value or a minimum value in that range, and reflectance in this range is relatively higher than that in other range, and "small" means that the lowest level of reflection spectrum is equivalent to the base line.

TABLE 1

| Colored particle No. (Toner No.) | Colorants employed | Relative intensity of reflection spectrum (Reflectance) 380-500 (nm) | 500-600 (nm) | 600-730 (nm) |
|---|---|---|---|---|
| 11 | C.I. Pigment Blue15:1 | Large | Large | Small |
| 12 | C.I. Pigment Red122 | Large | Small | Large |
| 13 | C.I. Pigment Yellow74 | Small | Large | Large |
| 14 | Carbon black | — | — | — |
| 15 | C.I. Pigment Red112 | Small | Small | Large |

TABLE 1-continued

| Colored particle No. (Toner No.) | Colorants employed | Relative intensity of reflection spectrum (Reflectance) 380-500 (nm) | 500-600 (nm) | 600-730 (nm) |
|---|---|---|---|---|
| 16 | Copper tetra-(α-hydroxyethoxy) phthalocyanine | Small | Large | Small |
| 17 | Anthraquinone derivative (ORACET blue 2R) | Large | Small | Small |

A word "small" in this figure means that relative intensity in reflection spectrum is equivalent to the base line.
A word "large" in this figure means that there is a maximum value or a minimum value of reflection spectrum in the designated range.

<Preparation of Toner 2 (21-27)>

(Toner for Example 2)

As to the manufacturing process of toner 1 (11-17), when a median particle diameter ($D_{50}$) in terms of volume reached 2.7 μm in a salting-out/fusing process, a sodium chloride aqueous solution was added to prevent particle growth. Further, a process of coagulating resin particle s1 for the surface with mother particle m1 was conducted similarly to preparation of toner 1 (11-17), except that when the average value of circularity reached 0.967, heating while stirring was terminated in the coagulating process. The particle diameter of the resulting colored particle was measured employing the foregoing Multisizer 3 (produced by Beckmann-Coulter Co.), resulting in a median diameter of 3.0 μm in terms of volume. Further, 7 color toner 2 (21-27) was prepared similarly to preparation of toner 1 (11-17), except that a hydrophobic silica having a number average primary particle diameter of 150 nm in a process of adding external additives was replaced by a hydrophobic titanium oxide having a number average primary particle diameter of 100 nm.

<Preparation of Toner 3 (31-37)>

(Toner for Example 3)

The process was conducted similarly to preparation of toner 1 (11-17), except that when a median particle diameter ($D_{50}$) in terms of volume reached 6.7 μm in a salting-out/fusing process, a sodium chloride aqueous solution was added to prevent particle growth, and further when the average value of circularity reached 0.967, heating while stirring was terminated in a process of coagulating resin particle s1 for the surface with mother particle m1. The particle diameter of the resulting colored particle was measured employing the foregoing Multisizer 3 (produced by Beckmann-Coulter Co.), resulting in a median diameter of 7.0 μm in terms of volume. Further, 7 color toner 3 (31-37) was prepared similarly to preparation of toner 1 (11-17), except that a hydrophobic silica having a number average primary particle diameter of 150 nm in a process of adding external additives was replaced by a hydrophobic strontium titanate having a number average primary particle diameter of 300 nm.

<Preparation of Toner 4 (41-47)>

(Toner for Example 4)

7 color toner 4 (41-47) was prepared similarly to preparation of toner 1 (11-17), except that a hydrophobic silica having a number average primary particle diameter of 150 nm in a process of adding external additives was replaced by a hydrophobic silica having a number average primary particle diameter of 40 nm.

<Preparation of Toner 5 (51-57)>

(Toner for Example 5)

7 color toner 5 (51-57) was prepared similarly to preparation of toner 3 (31-37), except that a hydrophobic strontium titanate having a number average primary particle diameter of 300 nm was replaced by a hydrophobic titanium oxide having a number average primary particle diameter of 800 nm.

<Preparation of Toner 6 (61-67)>

(Toner for Example 6)

7 color toner 6 (61-67) was prepared similarly to preparation of toner 1 (11-17), except that 60 g of an addition amount of vinyl polymer 1 was changed to 80 g in a manufacturing process of mother particle m1 in preparation of toner 1 (11-17).

<Preparation of Toner 7 (71-77)>

(Toner for Example 7)

7 color toner 7 (71-77) was prepared similarly to preparation of toner 1 (11-17), except that 60 g of an addition amount of vinyl polymer 1 was changed to 45.0 g in a manufacturing process of mother particle m1 in preparation of toner 1 (11-17).

<Preparation of Toner 8 (81-87)>

(Toner for Example 8)

In a manufacturing process of mother particle m1 in preparation of toner 1 (11-17), 60 g of an addition amount of vinyl polymer 1 was changed to 50.0 g, and in a process of coagulating resin particle s1 for the surface with mother particle m1, heating while stirring was terminated when an average value of circularity reached 0.998. Further, a hydrophobic silica having a number average primary particle diameter of 150 nm was replaced by a hydrophobic titanium oxide having a number average primary particle diameter of 650 nm to prepare 7 color toner 8 (81-87).

<Preparation of Toner 9 (91-97)>

(Toner for Comparative Example 1)

7 color toner 9 (91-97) was prepared similarly to preparation of toner 1 (11-17), except that when a median particle diameter ($D_{50}$) in terms of volume reached 7.5 μm in a salting-out/fusing process in preparation of toner 1 (11-17), a sodium chloride aqueous solution was added to prevent particle growth, and further when the average value of circularity reached 0.941, heating while stirring was terminated in a process of coagulating resin particle s1 for the surface with mother particle m1. In addition, the resulting toner had a median particle diameter ($D_{50}$) of 7.8 μm in terms of volume.

<Preparation of Toner 10 (101-107)>

(Toner for Comparative Example 2)

7 color toner 10 (101-107) was prepared similarly to preparation of toner 1 (11-17), except that when a median particle diameter ($D_{50}$) in terms of volume reached 2.2 μm in a salting-out/fusing process in preparation of toner 1 (11-17), a sodium chloride aqueous solution was added to prevent particle growth, and further when the average value of circularity reached 0.999, heating while stirring was terminated in a process of forming a toner particle outer layer, and also except that in a process of adding external additives, a hydrophobic silica having a number average primary particle diameter of 150 nm was replaced by a hydrophobic titanium oxide having a number average primary particle diameter of 100 nm.

<Preparation of Toner 11 (111-117)>

(Toner for Comparative Example 3)

7 color toner 11 (111-117) was prepared similarly to preparation of toner 1 (11-17), except that in a process of adding external additives, a hydrophobic silica having a number average primary particle diameter of 150 nm was replaced by a hydrophobic titanium oxide having a number average primary particle diameter of 24 nm.

<Preparation of Toner 12 (121-127)>

(Toner for Comparative Example 4)

7 color toner 12 (121-127) was prepared similarly to preparation of toner 1 (11-17), except that in a process of adding external additives, a hydrophobic silica having a number average primary particle diameter of 150 nm was replaced by a hydrophobic strontium titanate having a number average primary particle diameter of 1100 nm.

<Preparation of Toner 13 (131-137)>

(Toner for Comparative Example 5)

7 color toner 13 (131-137) was prepared similarly to preparation of toner 1 (11-17), except that 60.0 g of an addition amount of vinyl polymer 1 was changed to 30.0 g in a manufacturing process of mother particle m1 in preparation of toner 1 (11-17).

<Preparation of Toner 14 (141-147)>

(Toner for Comparative Example 6)

7 color toner 14 (141-147) was prepared similarly to preparation of toner 1 (11-17), except that 60.0 g of an addition amount of vinyl polymer 1 was changed to 90.0 g in a manufacturing process of mother particle m1 in preparation of toner 1 (11-17).

Properties concerning the resulting toners 1-14 are shown in Table 2. Incidentally, reflectance at 380-730 nm relating to the chromatic color toner in toners 2-14 was evaluated, employing the foregoing reflection spectroscopy meter GretagMcbeth SpectroScan (produced by Gretag Macbeth), resulting in the same result as that of toner 1.

<Preparation of Developer>

The ferrite carrier having a volume average particle diameter of 60 μm, coated by a silicone resin was mixed with each toner described in Table 1, mixing for 20 minutes with a V-shaped mixer so as to be 8% in toner concentration, to prepare developer 1 (11-17)-14 (141-147). The following evaluations employing developers 1-8 correspond to Examples 1-8, and those employing developers 9-14 correspond to Comparative examples 1-6.

2. Experiment for Evaluation (1) Evaluation Apparatus

The evaluation was conducted employing a full color image forming apparatus shown in FIG. 1 as an evaluation apparatus. In addition, a fixing speed of 245 mm/sec {about 50 sheets/min (at a cross-feed of A4 size)} and a surface temperature of a heat roll of 120° C. were arranged to be set.

Setting the surface temperature of a heat roll at 120° C. was based on the fact that when set at the said temperature, the surface temperature of an offset printing paper sheet discharged after fixing was confirmed to be 100° C. or less.

The exposure wavelength, exposure diameter and B, that is, A/B are controlled by a wavelength-variable receiver, a lens system, and a speed ratio of a photoreceptor and a developing roller, respectively to measure a toner image (dot diameter) on a photoreceptor employing a microscope. The average circularity was measured by the foregoing measuring method.

(2) Paper for Evaluation

Non-glossy paper (64 g $m^2$) prepared in the following procedures were used as a sheet (recording paper) for evaluation.

Leaf wood bleach kraft pulp (LBKP) was subjected to beating up to a freeness of 480 ml (Canada Standard Freeness, CSF). Further thereto, 0.2% by weight of synthetic sizing agent, SPS-300 (produced by Arakawa Kagaku Kogyou Co., Ltd.), 1.0% by weight of sulfuric acid band and 5% by weight of talc as an inorganic filler were added to prepare stuff. Using thus prepare stuff, paper making was conducted using Sim-

TABLE 2

| Toner No. | *1 | Circularity (Average value) | External additive condition Kinds | *2 | Vinyl polymer Addition amount (g) | Toner Decline starting temperature (° C.) | *3 |
|---|---|---|---|---|---|---|---|
| 1 | 5.5 | 0.956 | Hydrophobic silica | 150 | 60.0 | 25 | 85-115 |
| 2 | 3.0 | 0.967 | Hydrophobic titanium oxide | 100 | 60.0 | 25 | 85-115 |
| 3 | 7.0 | 0.957 | Strontium titanate | 300 | 60.0 | 25 | 85-115 |
| 4 | 5.5 | 0.950 | Hydrophobic silica | 40 | 60.0 | 25 | 85-115 |
| 5 | 7.0 | 0.957 | Hydrophobic titanium oxide | 800 | 60.0 | 25 | 85-115 |
| 6 | 5.5 | 0.956 | Hydrophobic silica | 150 | 80.0 | 10 | 70-100 |
| 7 | 5.5 | 0.956 | Hydrophobic silica | 150 | 45.0 | 40 | 100-130 |
| 8 | 5.6 | 0.998 | Hydrophobic silica | 650 | 50.0 | 20 | 75-105 |
| 9 | 7.8 | 0.941 | Hydrophobic silica | 150 | 60.0 | 25 | 85-115 |
| 10 | 2.8 | 0.999 | Hydrophobic titanium oxide | 100 | 60.0 | 25 | 85-115 |
| 11 | 5.5 | 0.956 | Hydrophobic titanium oxide | 24 | 60.0 | 25 | 85-115 |
| 12 | 5.5 | 0.956 | Strontium titanate | 1100 | 60.0 | 25 | 85-115 |
| 13 | 5.5 | 0.956 | Hydrophobic silica | 150 | 30.0 | 55 | 135-155 |
| 14 | 5.5 | 0.956 | Hydrophobic silica | 150 | 90.0 | 5 | 45-65 |

*1: Median particle diameter in terms of volume

*2: Primary particle diameter (nm)

*3: Temperature range in a storage elastic modulus of $10^3$-$10^4$ Pa (° C.)

former wet paper-making machine, BALMET (produced by Sumitomo Juko Co., Ltd.) at a speed of 950 m/min. A coating solution comprising polyvinyl alcohol and a permeating agent and having a solids content of 5% by weight (in which 15 ppm of polyethylene glycol type nonionic surfactant High Roob D550, produced by Daiichi Kogyo Seiyaku Co., Ltd., was incorporated per solid content of polyvinyl alcohol P-7000, produced by Nippon Gosei Kagaku Kogyo Co., Ltd.) was coated on both sides of a paper base in a gate roll size press apparatus to prepare nonglossy paper (form paper) having a total coating amount of 0.55 g/m$^2$ and a basis weight of 64 g/m$^2$. The glossiness of the thus prepared non-glossy paper was determined to be 6%.

(3) Evaluation

<Evaluation of Color Reproduction Area>

Totally output was the solid patch in 216 kinds of color, in which each of signal values of R, G and B results independently in any value of 0, 51, 102, 153, 204 and 255. The color measurement of all the colors was conducted employing a colorimetric meter X-Rite 938 produced by X-Rite to plot L*, a* and b* (D65 light source 2 degree visual field) in the space having the 3 axes, and an outermost volume of a flock of plotted 216 points was determined. The larger the volume is, the better the color reproduction. That is, this means an enlarged color reproduction area.

Rank A: At least 450000

Rank B: At least 400000 and less than 450000

Rank C: At least 340000 and less than 400000

Rank D: Less than 340000

<Evaluation of "Out of Color Registration">

Halftone images of skin color and amethyst were prepared to evaluate "out of color registration" employing a loupe at a magnification of 30 times.

Rank A: No "out of color registration" is observed.

Rank B: No "out of color registration" is visually observed, but it is slightly observed with a loupe (at most 50 μm).

Rank C: "out of color registration" is slightly observed with a loupe (at most 100 μm), but there is no problem at a practical level.

Rank D: "out of color registration" is visually observed.

<Evaluation of Toner Consumption>

Full color photographic images having a pixel ratio of 20% were printed onto A4 size 10000 paper sheets to evaluate by obtaining the sum of consumed toner of each color.

Rank A: Less than 30 mg/sheet

Rank B: At least 30 mg/sheet and less than 70 mg/sheet

Rank C: At least 70 mg/sheet and less than 100 mg/sheet

Rank C: At least 100 mg/sheet

<Fixing Ability of Halftone Image>

Halftone images of C, M, Y, Bk, R, G and B (toner coating amount of 0.2 mg/cm$^2$) were respectively output to evaluate by using a ratio of reflection density before and after rubbing 20 times with a load of 1 Pa.

Rank A: At least 90%

Rank B: At least 80% and less than 90%

Rank C: At least 70% and less than 80%

Rank D: Less than 70%

<Reproduction of Halftone Image>

Halftone images of 7 colors (toner coating amount of 0.2 mg/cm$^2$) were respectively output to evaluate via visual measurement or reflection density measurement.

A: Halftone images are clearly reproduced, and no reduced density at end portions is observed.

B: Halftone images are clearly reproduced, but reduced density of less than 0.04 in reflection density at end portions is observed, and there is no problem at a practical level.

D: Reduced density of at least 0.04 in reflection density at end portions is observed, and there is a problem at a practical level.

<Generation of Toner Blister (Image Defect)>

Non-glossy paper sheets are used as the evaluation paper sheet to form solid toner images in which a toner coating amount reaches 1.6 mg/cm$^2$ on a non-glossy paper sheet.

To evaluate the toner blister, the number of a pore (toner blister) size of 0.1-0.5 μm, generated in the above-described solid toner image, and the degree thereof are evaluated via visual observation.

Evaluation Criteria

A: No toner blister is observed. (Excellent)

B: One or two toner blisters per 4 cm$^2$ is/are observed, but there is no problem at a practical level. (Good)

D: At least 3 toner blisters per 4 cm$^2$ are observed, and there is a problem at a practical level. (No good)

<Fine Line Reproduction>

A line image corresponding to a 2 dot line image signal for each of 7 colors is prepared to measure the line width employing a printing evaluation system RT2000 (produced by YAMAN, Inc). To determine "pass" or "fail", samples in which a line width does not exceed 200 μm, and not less than 10 μm in line width is not changed between at the initial stage and after printing 2000 sheets (Pass), and samples other than the foregoing (Fail).

The above evaluation results are shown in Table 3.

TABLE 3

| | Developer No. | Toner No. | *1 | Out of color Registration | Toner consumption | *2 | Halftone image reproduction | Fine line reproduction | Toner blister |
|---|---|---|---|---|---|---|---|---|---|
| Example 1 | Developer 1 | Toner 1 | A | A | A | A | A | B | A |
| Example 2 | Developer 2 | Toner 2 | A | A | B | A | A | B | A |
| Example 3 | Developer 3 | Toner 3 | A | B | A | A | A | B | A |
| Example 4 | Developer 4 | Toner 4 | A | B | A | A | A | B | A |
| Example 5 | Developer 5 | Toner 5 | A | B | A | A | A | B | A |
| Example 6 | Developer 6 | Toner 6 | B | A | A | B | B | B | A |
| Example 7 | Developer 7 | Toner 7 | B | A | A | B | B | B | A |
| Example 8 | Developer 8 | Toner 8 | B | B | B | B | B | B | B |
| Comparative example 1 | Developer 9 | Toner 9 | C | C | C | B | B | D | D |
| Comparative example 2 | Developer 10 | Toner 10 | C | B | D | B | B | D | B |
| Comparative example 3 | Developer 11 | Toner 11 | D | D | D | C | D | D | D |

TABLE 3-continued

| | Developer No. | Toner No. | *1 | Out of color Registration | Toner consumption | *2 | Halftone image reproduction | Fine line reproduction | Toner blister |
|---|---|---|---|---|---|---|---|---|---|
| Comparative example 4 | Developer 12 | Toner 12 | D | D | D | C | D | D | D |
| Comparative example 5 | Developer 13 | Toner 13 | D | C | D | D | D | D | D |
| Comparative example 6 | Developer 14 | Toner 14 | D | C | D | D | D | D | D |

*1: Evaluation for color reproduction area,
*2: Halftone image fixing ability

As is clear from Table 3, it is to be understood that excellent evaluation results higher than at a practical level concerning any one of color reproduction, toner blister and fine line reproduction have been obtained in Examples 1-8, whereas some of the results in the evaluation items are insufficiently achieved with no effects of the present invention in Comparative examples 1-6. In addition, the same evaluation was made similarly to the above examples employing the apparatus shown in FIG. 3, and it is to be understood that the same effect was obtained.

EFFECT OF THE INVENTION

In the present invention, it has become possible to expand greatly a formable color area, by reducing the number of colors to be superimposed, by increasing the number of toner color types. It has further come to be capable of reducing superposition of toner and reducing an amount of toner consumption in the course of color image forming. As a result, it has become possible to reproduce images with subtle hue such as color halftone images on a high fidelity basis, and to prepare, for example, printed matters which are required to reproduce accurately those having subtle hue such as a company logo mark.

In the present invention, attention was paid to dynamic viscoelasticity of toner, and by controlling storage elastic modulus of toner, it has become possible to form toner images stably under the condition where an influence of moisture contained in a sheet is hardly revealed. Therefore, excellent toner images can be formed stably even when a sheet other than PPC paper such as a sheet for offset printing is used.

What is claimed is:

1. A color image forming method comprising:

(a) charging plural photoreceptors;

(b) conducting an exposure process to each of surfaces of the plural photoreceptors charged in step (a) to form plural electrostatic latent images;

(c) developing the plural electrostatic latent images with different color toners corresponding to the plural electrostatic latent images to form different color toner images via step (b); and (d) transferring each of the different color toner images via superimposition of the different color toner images on a recording material or an intermediate image transfer material, wherein the different color toners comprise at least 6 kinds of chromatic color toners having different reflection spectra and a black toner, and each of the at least 6 kinds of chromatic color toners and the black toner comprises particles having a median particle diameter (D50) of 3-7 μm in terms of volume, and an external additive having a primary diameter of 40-800 nm; and wherein each of the at least 6 kinds of chromatic color toners and the black toner has a decline starting temperature of a storage elastic modulus of 10-40° C., and a temperature of 70-130° C. in the storage elastic modulus range of $10^3$-$10^4$ Pa.

2. The color image fanning method of claim 1, wherein the at least 6 kinds of chromatic color toners having different reflection spectra comprise:

a first kind of chromatic color toner in which reflectance at not less than 500 nm and less than 730 nm is relatively higher than that at not less than 380 nm and less than 500 nm;

a second kind of chromatic color toner in which reflectance at not less than 380 nm and less than 500 nm is relatively higher than that at not less than 500 nm and less than 730 nm;

a third kind of chromatic color toner in which reflectance at not less than 500 nm and less than 600 nm is relatively higher than that at not less than 380 nm and less than 500 nm, and at not less than 600 nm and less than 730 nm;

a fourth kind of chromatic color toner in which reflectance at not less than 380 nm and less than 500 nm, and at not less than 600 nm and less than 730 ml is relatively higher than that at not less than 500 nm and less than 600 nm;

a fifth kind of chromatic color toner in which reflectance at not less than 600 nm and less than 730 nm is relatively higher than that at not less than 380 nm and less than 600 nm; and a sixth kind of chromatic color toner in which reflectance at not less than 380 nm and less than 600 nm is relatively higher than that at not less than 600 nm and less than 730 nm.

3. The color image forming method of claim 1, wherein each of the different color toners is prepared via a process of associating resin particles in an aqueous medium.

4. The color image forming method of claim 1, wherein each of the different color toners comprises a vinyl polymer in an amount of 1 to 15 percent by weight of the toner, the vinyl polymer has a glass transition point in the range of −100 to 20° C., a peak molecular a peak molecular weight in the range of 300 to 3400, and a ratio of weight average molecular weight to number average molecular weight (Mw/Mn) is in a range of 1.2 to 2.4, and the glass transition point of each of the vinyl polymer is 10-150° C. lower than glass transition points of each binder resin contained in each of the plural different color toners.

5. The color image forming method of claim 4, the vinyl polymer comprises a butyl acrylate, 2-ethyl hexyl acrylate or a mixture thereof as a monomer unit in an amount of 50 percent by weight of the vinyl polymer or more.

6. The color image forming method of claim 1, wherein the different color toners comprise a yellow toner, a magenta toner, a cyan toner, a red toner, a blue toner, a green toner and the black toner.

7. The color image forming method of claim 6, wherein the different color toners further comprise a transparent toner, a white toner or both.

8. The color image forming method of claim 7, wherein the transferring transfers a toner image formed by using the transparent toner at the first or the last of the different color toner images.

9. The color image forming method of claim 1, wherein an exposure light source employed in the exposure process is a source of laser light having a wavelength of 380-530 nm.

10. The color image Conning method of claim 1, wherein each of the different color toners has an average value of circularity of 0.956-0.998.

11. A color image forming method by using different color toners comprising at least 6 kinds of chromatic color tuners having different reflection spectra and a black toner, the method comprising:

(a) charging a photoreceptor;

(b) conducting an exposure process to a surface of the photoreceptor charged in step (a) to form an electrostatic latent image;

(c) developing the electrostatic latent image with one of different color toners to form a toner image; and (d) transferring the toner images to a recording material, wherein each of the at least 6 kinds of chromatic color toners and the black toner comprises particles having a median particle diameter (D50) of 3-7 μm in terms of volume, and an external additive having a primary diameter of 40-800 nm; and wherein each of the at least 6 kinds of chromatic color toners and the black toner has a decline starting temperature of a storage elastic modulus of 10-40° C., and a temperature of 70-130° C. in the storage elastic modulus range of $10^3$-$10^4$ Pa.

12. The color image forming method of claim 11, wherein the at least 6 kinds of chromatic color toners having different reflection spectra comprise:

a first kind of chromatic color toner in which reflectance at not less than 500 nm and less than 730 nm is relatively higher than that at not less than 380 nm and less than 500 nm;

a second kind of chromatic color toner in which reflectance at not less than 380 nm and less than 500 nm is relatively higher than that at not less than 500 nm and less than 730 nm;

a third kind of chromatic color toner in which reflectance at not less than 500 nm and less than 600 nm is relatively higher than that at not less than 380 nm and less than 500 nm, and at not less than 600 nm and less than 730 nm;

a fourth kind of chromatic color toner in which reflectance at not less than 380 nm and less than 500 nm, and at not less than 600 nm and less than 730 nm is relatively higher than that at not less than 500 nm and less than 600 nm;

a fifth kind of chromatic color toner in which reflectance at not less than 600 nm and less than 730 nm is relatively higher than that at not less than 380 nm and less than 600 nm; and a sixth kind of chromatic color toner in which reflectance at not less than 380 nm and less than 600 nm is relatively higher than that at not less than 600 nm and less than 730 nm.

13. The color image forming method of claim 11, wherein each of the different color toners is prepared via a process of associating resin particles in an aqueous medium.

14. The color image forming method of claim 11, wherein each of the different color toners comprises a vinyl polymer in an amount of 1 to 15 percent by weight of the toner, the vinyl polymer has a glass transition point in the range of −100 to 20° C., a peak molecular a peak molecular weight in the range of 300 to 3400, and a ratio of weight average molecular weight to number average molecular weight (Mw/Mn) is in a range of 1.2 to 2.4, and the glass transition point of each of the vinyl polymer is 10-150° C. lower than glass transition points of each binder resin contained in each of the plural different color toners.

15. The color image forming method of claim 11, wherein the steps (a) to (c) are repeated in number of kind of the different color toners, and each of color toner images is transferred to a recording material one by one.

16. The color image forming method of claim 11, wherein the different color toners comprise a yellow toner, a magenta toner, a cyan toner, a red toner, a blue toner, a green toner and the black toner.

17. The color image forming method of claim 16, wherein the different color toners further comprise a transparent toner, a white toner or both.

18. The color image forming method of claim 17, wherein the transferring transfers a toner image formed by using the transparent toner at the first or the last of the different color toner images.

19. The color image forming method of claim 11, wherein an exposure light source employed in the exposure process is a source of laser light having a wavelength of 380-530 nm.

20. The color image forming method of claim 11, wherein each of the different color toners has an average value of circularity of 0.956-0.998.

* * * * *

UNITED STATES PATENT AND TRADEMARK OFFICE

CERTIFICATE OF CORRECTION

PATENT NO. : 7,642,023 B2
APPLICATION NO. : 11/474894
DATED : January 5, 2010
INVENTOR(S) : Nagase et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 655 days.

Signed and Sealed this

Twenty-first Day of December, 2010

David J. Kappos

David J. Kappos
*Director of the United States Patent and Trademark Office*